US011031201B2

(12) United States Patent
Fu et al.

(10) Patent No.: US 11,031,201 B2
(45) Date of Patent: Jun. 8, 2021

(54) HIGH POWER AND HIGH INSULATION PERFORMANCE RELAY FOR SOLAR PHOTOVOLTAIC INVERTER

(71) Applicant: Xiamen Hongfa Electroacoustic Co., Ltd., Fujian (CN)

(72) Inventors: Feifei Fu, Xiamen (CN); Jinqiang Liu, Xiamen (CN); Zhonghua Tan, Xiamen (CN); Yiqing Zhu, Xiamen (CN)

(73) Assignee: Xiamen Hongfa Electroacoustic Co., Ltd., Fujian (CN)

( * ) Notice: Subject to any disclaimer, the term of this patent is extended or adjusted under 35 U.S.C. 154(b) by 188 days.

(21) Appl. No.: 16/477,124

(22) PCT Filed: Jan. 12, 2018

(86) PCT No.: PCT/CN2018/072494

§ 371 (c)(1),
(2) Date: Jul. 10, 2019

(87) PCT Pub. No.: WO2018/130209

PCT Pub. Date: Jul. 19, 2018

(65) Prior Publication Data

US 2019/0362923 A1 Nov. 28, 2019

(30) Foreign Application Priority Data

Jan. 11, 2017 (CN) ..... 201710019439.2
Apr. 27, 2017 (CN) ..... 201710286750.3

(51) Int. Cl.
*H01H 51/22* (2006.01)
*H01H 50/18* (2006.01)
(Continued)

(52) U.S. Cl.
CPC ..... *H01H 50/18* (2013.01); *H01H 50/36* (2013.01); *H01H 71/24* (2013.01)

(58) Field of Classification Search
CPC ..... H01H 50/36; H01H 71/24; H01H 50/18
(Continued)

(56) References Cited

U.S. PATENT DOCUMENTS 4,833,435 A * 5/1989 Ohara ..... H01H 51/20 335/119
5,734,308 A * 3/1998 Dittmann ..... H01H 50/36 335/128
(Continued)

FOREIGN PATENT DOCUMENTS

CN 204696042 U 10/2015
CN 105374633 A 3/2016
(Continued)

OTHER PUBLICATIONS

International Search Report and Written Opinion for International Application No. PCT/CN2018/072494 dated Apr. 20, 2018.

*Primary Examiner* — Alexander Talpalatski
(74) *Attorney, Agent, or Firm* — Wolf, Greenfield & Sacks, P.C.

(57) ABSTRACT

A high power and high insulation performance relay for a solar photovoltaic inverter includes a base, a coil, an iron core, an armature part, a yoke iron, a movable spring and a stationary spring. The armature part includes a connecting piece as one side of the armature part, an armature as the other side of the armature part, and a plastic member; the armature and the connecting piece are connected with the plastic member respectively and are insulated and isolated; the plastic member is provided with at least one groove or rib; the stationary spring includes a stationary reed which includes a first coupling part for fixing a stationary contact, a second coupling part used as a lead-out pin, and a bending part between the both: the bending part is located outside of a base plate of the base when the stationary reed is mounted on the base.

11 Claims, 10 Drawing Sheets

(51) Int. Cl.
*H01H 50/36* (2006.01)
*H01H 71/24* (2006.01)

(58) Field of Classification Search
USPC ..... 335/128
See application file for complete search history.

(56) References Cited

U.S. PATENT DOCUMENTS

| | | | | |
|---|---|---|---|---|
| 9,711,311 | B2 * | 7/2017 | Yamagata | H01H 50/546 |
| 10,269,516 | B2 * | 4/2019 | Aratani | H01H 50/14 |
| 2005/0190025 | A1 * | 9/2005 | Yamamoto | H01H 50/546<br>335/128 |
| 2014/0151337 | A1 * | 6/2014 | Hiraiwa | H01H 9/443<br>218/26 |

FOREIGN PATENT DOCUMENTS

| | | | |
|---|---|---|---|
| CN | 205177723 | U | 4/2016 |
| EP | 2741307 | B1 | 3/2017 |

* cited by examiner

HIGH POWER AND HIGH INSULATION PERFORMANCE RELAY FOR SOLAR PHOTOVOLTAIC INVERTER

RELATED APPLICATIONS

This Application is a national stage filing under 371 U.S.C. 371 of International Patent Application Serial Number PCT/CN2018/072494, filed on Jan. 12, 2018, entitled High Power and High Insulation Performance Relay for Solar Photovoltaic Inverter". Foreign priority benefits are claimed under 35 U.S.C. § 119(a)-(d) or 35 U.S.C. § 365(b) of Chinese Patent Application No. 201710286750.3, filed Apr. 27, 2017 and Chinese application number 201710019439.2, filed Jan. 11, 2017.

TECHNICAL FIELD

The present disclosure relates to the technical field of relay, and particularly, relates to a high power and high insulation performance relay for solar photovoltaic inverter.

BACKGROUND

With the rapid development of the solar photovoltaic industry, higher requirements have been put forward for relays for solar photovoltaic inverter, especially higher requirements have been put forward for relay loads. According to market requirements, a high power relay of which the load voltage should reach 800 Va.c. and the switching current should reach at least 90 A is needed to develop. Appropriate creepage distance and clearance should be set according to the actual operating environment requirements (air pressure, pollution, etc.), while the used relays should be complied with the relevant standards. It is needed to have sufficient insulation properties to ensure the safety of people's lives and property and the stability of electrical performance.

The existing relay for solar photovoltaic inverter is generally adopted a clapper-type magnetic circuit, and the relay includes a base, a coil, an iron core, an armature, a yoke iron, a movable spring, a stationary spring, and the like. The coil is mounted on the base, the iron core is inserted into the coil, and the yoke iron is arranged at the coil, and the armature is matched at the knife edge of the yoke iron. When the coil is working, one end of the armature is sucked to the iron core and drives the movable contact of the movable spring to be contacted with the stationary contact of the stationary spring. The existing relay structure with a lower switching load voltage cannot meet the requirements of high power switching capability. On the other hand, it cannot directly meet the requirements of high insulation performance (high creepage distance). The creepage distance thereof cannot meet the requirements under 800 Va.c.

On the other hand, with the rapid development of the new energy industry, higher requirements are put forward on the distribution circuit power. The traditional distribution power below 220 VAC to 400 VAC/50 A cannot meet the development requirements of the society. Therefore, the development of high power electromagnetic relay with rated voltage greater than 400 VAC and current greater than 50 A is a future development requirement.

However, when the interrupting load voltage is reached more than 400 VAC and the interrupting current is reached more than 50 A, an extremely high energy electric arc is generated between the relay contacts, which will easily burn the plastic around the contacts and cause insulation degradation. Moreover, under the above described load, since the electric arc energy is extremely strong, and the voltage recovery speed is fast, the electric arc reignition phenomenon is easily generated even after the load crosses zero, such that the relay cannot extinguish the electric arc such as in the 220 VAC system at the normal voltage zero-crossing time. Therefore, most of the current high-power relays cannot meet the load of interrupting high voltage and high current.

In order to reduce the electric arc burning the plastic and effectively extinguishing the electric arc, the prior art is mainly adopted the following manners to achieve:

The first is to use ceramic blocking and cooling electric arc. As disclosed in Chinese patent CN106098479A, such kind relay is adopted ceramic to block the electric arc and avoid the electric arc burning plastic. Such relay can only prevent the electric arc from splashing in the direction toward the plastic, but cannot separate the electric arc into multi-segment short arcs, and cannot guide the electric arc to burn in the specified direction, thereby such relay cannot fundamentally reduce the energy of the electric arc. Further, the electric arc heat dissipation is slow. Therefore, although there is certain effect in avoiding the electric arc burning the plastic, such relay has poor effect in reducing the electric arc energy and avoiding the alternating current electric arc reignition.

The second is magnetic quenching, as disclosed in Chinese patent CN102306572A. Such relay is adopted magnetic field blowing arc to block high voltage direct current. Such relay is adopted a permanent magnet blowing arc to lengthen and change the direction of the electric arc, thereby extinguishing the electric arc. However, due to the introduction of the permanent magnet blowing arc, the current direction must be clearly specified in order to ensure that the electric arc is stretched in the specified direction after the permanent magnet is mounted and the direction is fixed. Therefore, such relay can only be applied in the direct current system, and the application field thereof is greatly restricted.

The third is the magnetic blowing arc+insulated ceramic chip cooling electric arc. As disclosed in Chinese patent CN103985604A, such relay is adopted permanent magnet blowing arc to lengthen and change the electric arc direction, and adopting the insulated ceramic chip to block and cool the electric arc. The basic principle of such arc extinguishing manner is "lengthening electric arc+cooling electric arc", which has a certain effect on extinguishing the electric arc. However, in the same way, since the permanent magnet blowing arc is introduced, the current direction must be clearly specified. Although the disclosed technical solution is not specified to be applicable only to a direct current load, in practical applications, since the permanent magnet has been fixedly mounted, the N and S directions thereof have been fixed, and it is impossible to arbitrarily adjust the N and S directions. Therefore, for the alternating current load, especially for the alternating current load of voltage above 400 VAC, it will inevitably lead to the disorder of the electric arc direction, the electric arc extinguishing effect is poor and even the phenomenon of burning component is appeared. In addition, since the insulated ceramic piece is adopted, it can only block the electric arc, and cannot guide the electric arc direction, and can only play a role of cooling the electric arc, but cannot form multi-segment short arcs, thus cannot really reduce the electric arc energy.

SUMMARY

The purpose of the embodiments of the present disclosure is to overcome the deficiencies of the existing technology and a high power and high insulation performance relay for a solar photovoltaic inverter is provided. Through the structure improvement, it can not only meet the requirements of high power switching capability, but also meet the requirements of high insulation performance (high creepage distance), and has the characteristics of good arc extinguishing effect, simple structure and convenient processing.

The technical solution adopted in the embodiment of the present disclosure to solve the technical problem thereof is: A high power and high insulation performance relay for a solar photovoltaic inverter includes a base, a coil, an iron core, an armature part, a yoke iron, a movable spring and a stationary spring; the coil, the iron core and the yoke iron are matched with each other and mounted on the base; the armature part is L-shaped, and the armature part is matched at the knife edge of the yoke iron; one side of the armature part is connected with the movable spring, and the other side of the armature part is matched with the iron core; the armature part includes a connecting piece as one side of the armature part, an armature as the other side of the armature part, and a plastic member; the armature and the connecting piece are connected with the plastic member respectively, and the armature and the connecting piece are insulated and isolated in the plastic member; the plastic member is provided with at least one groove or at least one rib for increasing the creepage distance between the armature and the connecting piece; the stationary spring includes a stationary reed; the stationary reed is composed of a first coupling part for fixing a stationary contact, a second coupling part used as a lead-out pin, and a bending part between the first coupling part and the second coupling part; the bending part is located outside of a base plate of the base when the stationary reed is mounted on the base.

The stationary contact is fixed on the inner side of the first coupling part of the stationary reed in the thickness direction of the first coupling part, such that a matching position of a movable contact and the stationary contact is above the bending part of the stationary reed; a magnetic field generated by a current flowing through the bending part of the stationary reed can be utilized to generate an upward electrodynamic force at a disconnection position of the movable contact and the stationary contact to achieve arc extinguishing.

The armature and the connecting piece are integrally connected through the plastic member by means of insert molding.

The base is provided with a slot for clamping the stationary reed; two sides of the first coupling part of the stationary reed in the width direction of the stationary reed are provided with a convex part respectively; the stationary reed is interference fit with the slot of the base by means of the convex parts on two sides of the stationary reed, such that the stationary reed is clamped on the base.

A upper edge of the convex part on two sides of the first coupling part of the stationary reed in the width direction of the stationary reed is further designed as a slope, such that the stationary reed can be inserted into the base from the outside of the base plate of the base.

At an edge corresponding to the slot, the base plate of the base is further provided with a giving way part that can be passed through by the stationary contact fixed on the first coupling part of the stationary reed.

The bending part of the stationary reed is further provided with a through-hole along the thickness direction of the bending part.

The second coupling part of the stationary reed is designed as a bifurcation structure.

The groove or the rib of the plastic member is arranged along the width direction of the armature.

The movable spring comprises a movable reed, a movable contact and a spacer; the movable contact and the spacer are fixed by riveting with each other to form a movable contact part; one end of the movable reed and the connecting piece of the armature part are fixed by riveting with each other; the other end of the movable reed and the movable contact part are fixed with each other.

The movable contact and the spacer are an integral structure or two separate parts.

Compared with the existing technology, the beneficial effects of the embodiments of the present disclosure are:

1. Since the embodiment of the present disclosure is adopted that an armature part is designed to include an armature as one side of the armature part, a connecting piece as the other side of the armature part and a plastic member. The armature and the connecting piece are integrally connected by means of insert molding. The armature and the connecting piece are insulated and isolated in the plastic member. The plastic member is arranged with at least one groove or at least one rib for increasing the creepage distance between the armature and the connecting piece. In such structure of the embodiment of the present disclosure, by adding grooves or ribs to the insert molding position of the armature part, the creepage distance between the connecting piece and the armature is increased under the condition of ensuring the molding strength of the insert, which can satisfy the product with a larger creepage distance (the creepage distance of the representing product is up to more than 12.5 mm), simple structure, convenient processing, and can satisfy the demand of high-voltage load.

2. Since the embodiment of the present disclosure is adopted that the stationary spring is designed to include a first coupling part for fixing a stationary contact, a second coupling part used as a lead-out pin, and a bending part between the first coupling part and the second coupling part. When the stationary reed is mounted on the base, the bending part is located outside of a base plate of the base. Such structure in the embodiment of the present disclosure can ensure that in the case of a specific lead-out pin position (the lead-out pin spacing can be adjusted according to the bending part), the splash during the process of switching the load are directly fell on the base, and the splash is prevented from falling directly on the metal (stationary reed) to cause the decline of the withstand voltage of the product, and the reliability of the insulation performance of the product is improved.

3. Since the embodiment of the present disclosure is adopted that the bending part is designed on the stationary reed, and the stationary contact is fixed on the inner side of the first coupling part of the stationary reed in the thickness direction of the first coupling part, so that the matching position of the movable contact and the stationary contact is above the bending part of the stationary reed. Such structure in the embodiment of the present disclosure can utilize the magnetic field generated by the current flowing through the bending part of the stationary reed to generate an upward electrodynamic force at the disconnection position of the movable contact and the stationary contact to achieve arc extinguishing, thereby increasing the arc extinguishing capability and providing the reliability of the contact switching load.

4. Since the embodiment of the present disclosure is adopted that a through-hole is further arranged in the bending part of the stationary reed along the thickness direction of the bending part, and the second coupling part of the stationary reed is designed as a bifurcation structure. The speed of heat transfer can be reduced, and the welding performance of the large capacity lead-out pin is improved.

In another aspect of the embodiment of the present disclosure, an electromagnetic relay resistant to high voltage and high current load is provided. By improving the arc extinguishing structure, not only the load of interrupting high voltage and high current can be satisfied, but also the electric arc burning plastic can be effectively avoided. And electric arc energy can be reduced. Further, such relay is suitable for alternating current and direct current loads.

An electromagnetic relay resistant to high voltage and high current load is provided, the electromagnetic relay includes two movable contacts, a movable reed that is bridged to the two movable contacts, and two stationary contacts correspondingly matched with the two movable contacts. One of the stationary contacts is set as current inflow. The other stationary contact is set as current outflow. so that the electric arc generated between the two pairs of contacts is splashed outwards along the line connecting the gaps of the two pairs of contacts. A first guide arc piece is respectively arranged at the outside of the line connecting the gaps of the two pairs of contacts to prevent the corresponding electric arc from flying outwards along the line connecting the gaps of the two pairs of contacts. The first guide arc piece is made of a conductive metal material. The first guide arc piece with respect to the connecting line of the gaps of the two pairs of contacts is obliquely arranged to enable the blocked electric arc to be able to guide to move along the preset arc leading direction of the first guide arc piece.

According to an embodiment of the present disclosure, in any one of the foregoing embodiment, the first guide arc piece and the contact circuit are insulated from each other. One end of the first guide arc piece is fixed on a side away from the stationary contact. The other end of the first guide arc piece is extended from the fixed position towards the direction of the stationary contact until to a position close to the stationary contact, so that the preset arc leading direction is towards the direction away from the stationary contact.

According to an embodiment of the present disclosure, in any one of the foregoing embodiment, a second guide arc piece is further respectively arranged at the outside of the line connecting the gaps of the two pairs of contacts. The second arc guide is made of a conductive metal material. The second guide arc piece and the contact circuit are insulated from each other. The second guide arc piece and the first guide arc piece are also insulated from each other. One end of the second guide arc piece is fixed on a side away from the stationary contact. The other end of the second guide arc piece is extended from the fixed position towards the direction of the contact gap until to a position close to the movable contact, so that the first guide arc piece and the second guide arc piece are enclosed to form a guide arc channel, and the preset arc leading direction is towards the direction deviate from the stationary contact.

According to an embodiment of the present disclosure, in any one of the foregoing embodiment, the size of the distance between the other end of the first guide arc piece and the other end of the second guide arc piece is not less than the size of the contact gap. Thereby, the electric arc generated between the contacts can be largely entered into the guide arc channel surrounded by the first guide arc piece and the second guide arc piece.

According to an embodiment of the present disclosure, in any one of the foregoing embodiment, the size of the distance between the fixed position of one end of the first guide arc piece and the fixed position of one end of the second guide arc piece is greater than the size of the distance between the other end of the first guide arc piece and the other end of the second guide arc piece, so that the guide arc channel is as a trumpet shape structure with a small opening and a large inside.

According to an embodiment of the present disclosure, in any one of the foregoing embodiment, the other end of the second guide arc piece is provided with a bending part. The tail end of the other end of the second guide arc piece is approximately parallel to the other end of the first guide arc piece.

According to an embodiment of the present disclosure, in any one of the foregoing embodiment, the outside of the line connecting the gaps of the two pairs of contacts is further provided with at least one third guide arc piece, The third guide arc piece is made of a conductive metal material. The third guide arc piece and the contact loop are insulated with each other. The third guide arc piece, the first guide arc piece and the second guide arc piece are also insulated with each other. The third guide arc piece is disposed between the first guide arc piece and the second guide arc piece or disposed outside the first guide arc piece and the second guide arc piece.

According to an embodiment of the present disclosure, in any one of the foregoing embodiment, the electromagnetic relay further includes a base for mounting the stationary contact and made of a plastic material, and the first guide arc piece fixed on the base. Or the electromagnetic relay further includes the second guide arc piece fixed on the base. Or the electromagnetic relay further includes the third guide arc piece fixed on the base.

An electromagnetic relay resistant to high voltage and high current load related to the foregoing embodiment of the present disclosure is provided with at least one guide arc piece which is respectively arranged at the outside of the line connecting the two pairs of contacts and used for preventing the corresponding electric arc from flying outwards along the line connecting the two pairs of contacts. The guide arc piece is made of a conductive metal material. The guide arc piece with respect to the connecting line of the two pairs of contacts is obliquely arranged to enable the blocked electric arc can be guided to move along the preset arc leading direction of the guide arc piece. In such structure of the embodiment of the present disclosure, the electric arc is immediately formed a multi-segment short arcs in series when the moving electric arc hits the conductive metal guide arc piece, so that the voltage between each segment short arc has a double drop, and greatly reducing the recovery rate of the voltage and reducing the energy of the arc. Further, the arc burning point is moved along the surface of the metal guide arc piece, thereby accelerating the heat dissipation and speeding up the recovery rate of the medium. Therefore, for direct current electric arc, the electric arc is more easily extinguished. For alternating current arc, the problem of the electric arc reignition can be effectively avoided when the voltage crosses zero. In the embodiment of the present disclosure, a certain included angle between the arranged metal guide arc piece and the line connecting the gaps of the two pairs of contacts is formed. In addition to preventing the change of the electric arc direction, the metal guide arc piece can also guide the electric arc to move along the metal surface. By properly setting the angle of the guide arc piece, the electric arc can be effectively guided to move towards the direction away from the plastic to avoid the electric arc burning the plastic.

The present disclosure will be further described in detail below with reference to the accompanying drawings and embodiments. However, a high power and high insulation performance relay for a solar photovoltaic inverter of an embodiment of the present disclosure is not limited to the embodiment.

DETAILED DESCRIPTION

Figure 1:
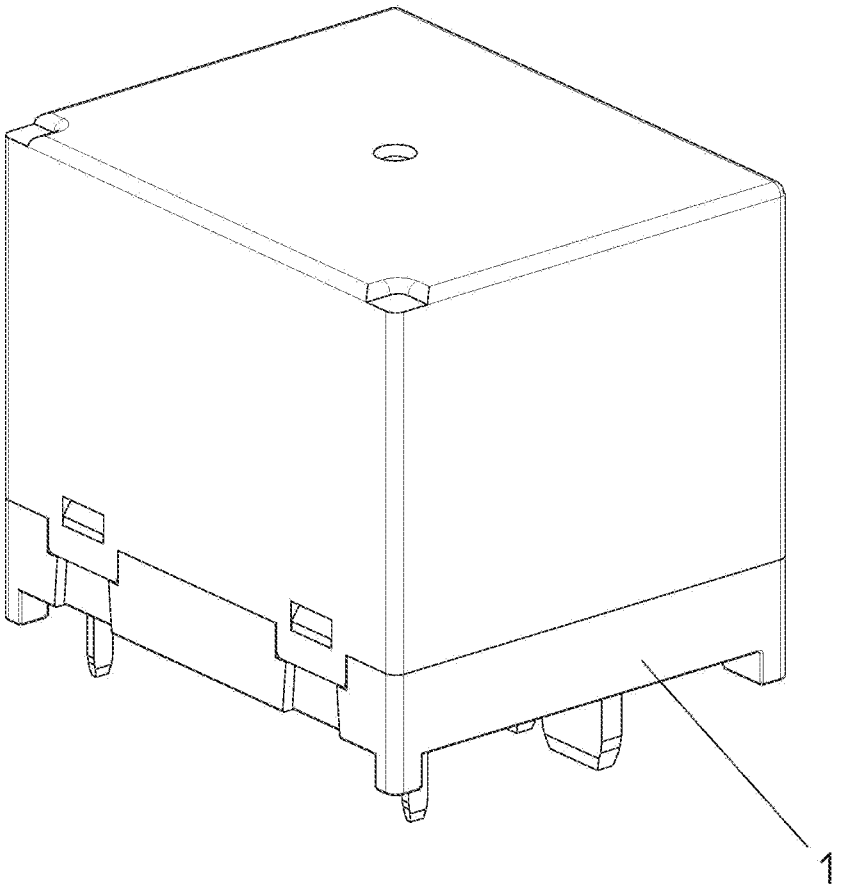
FIG. 1 is an external schematic view of an embodiment of the present disclosure.
Figure 2:
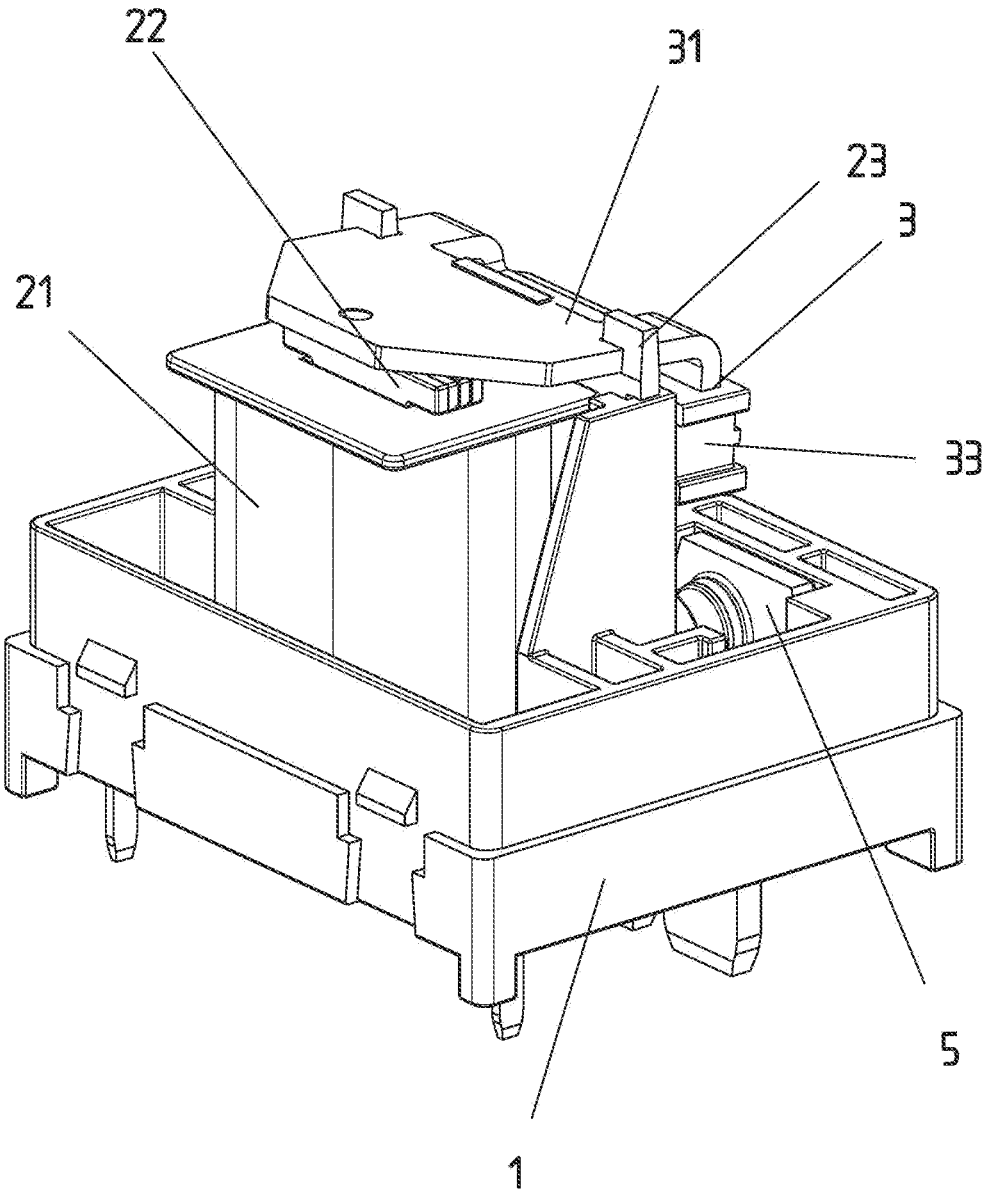
FIG. 2 is a perspective structure view of the embodiment of the present disclosure (without the outer shell)
Figure 3:
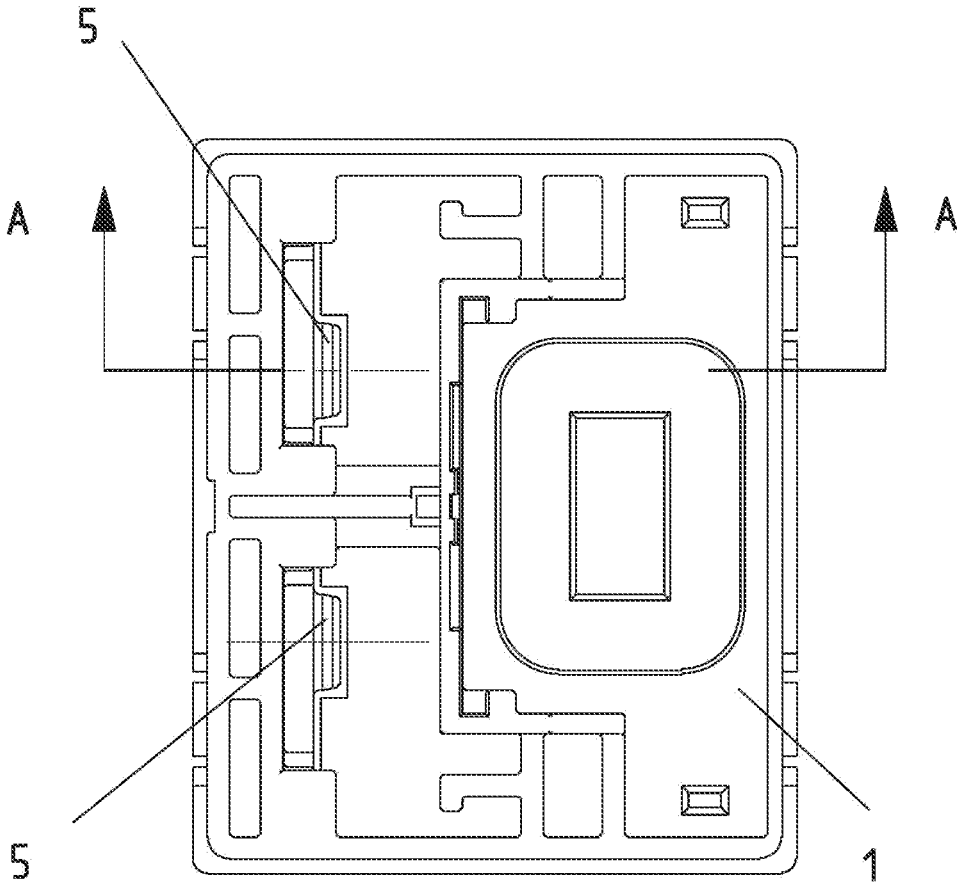
FIG. 3 is a top view of a base part (including a stationary spring) of the embodiment of the present disclosure.
Figure 4:
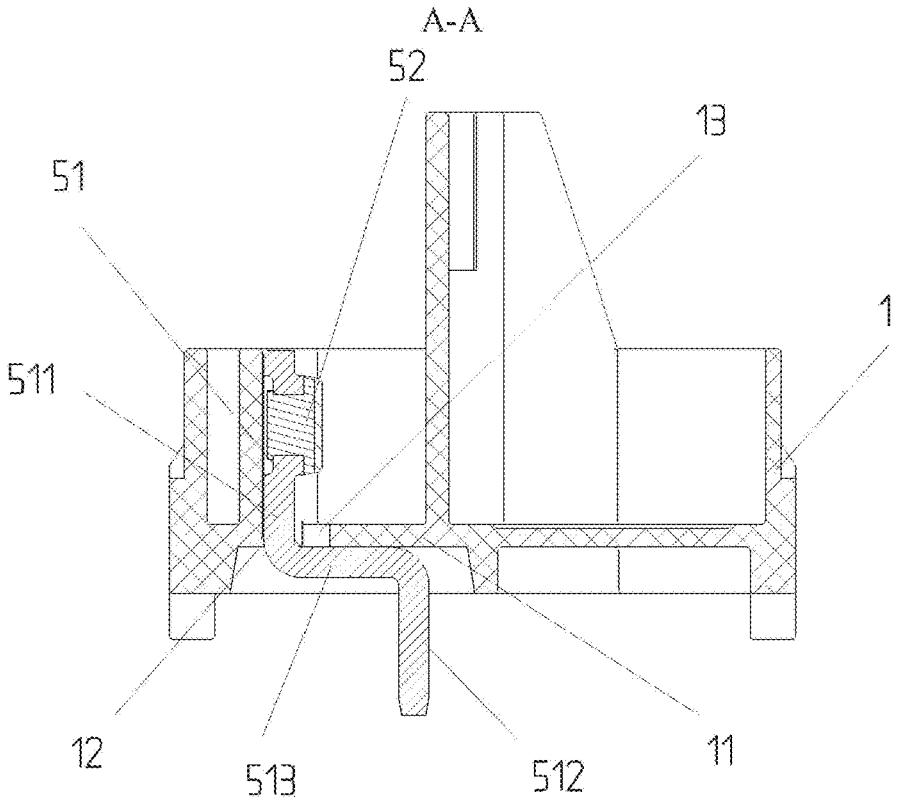
FIG. 4 is a cross-sectional view taken along the line A-A in FIG. 3.
Figure 5:
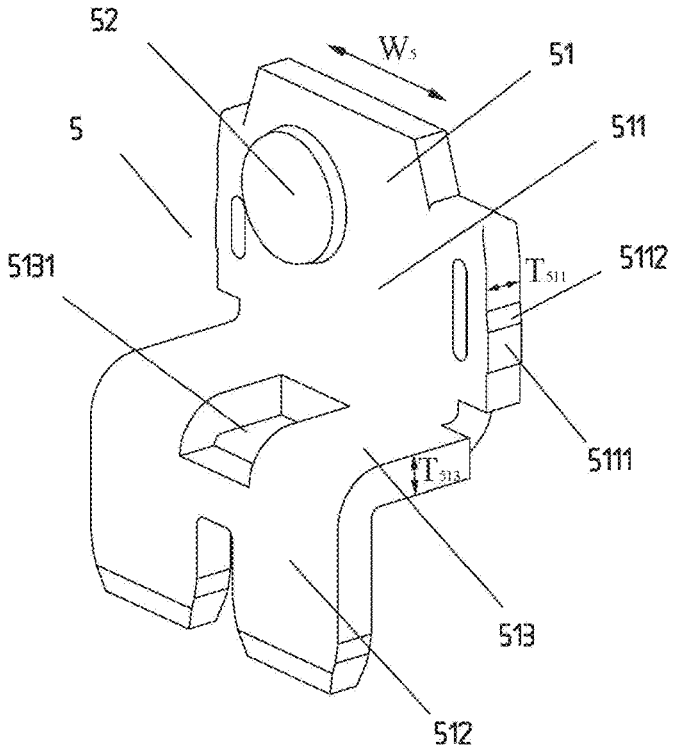
FIG. 5 is a perspective structure view of the stationary spring of the embodiment of the present disclosure.
Figure 11:
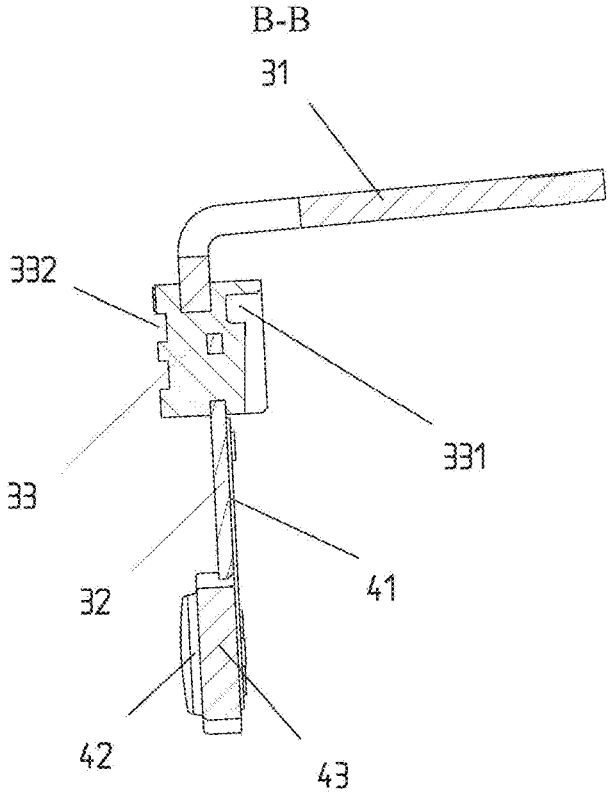
FIG. 11 is a cross-sectional view taken along the line B-B in FIG. 8.

Referring to FIG. 1 to FIG. 11, a high power and high insulation performance relay for a solar photovoltaic inverter in the embodiment of the present disclosure includes a base 1, a coil 21, an iron core 22, an armature part 3, a yoke iron 23, a movable spring 4 and a stationary spring 5. The coil 21 includes a bobbin and an enameled wire wound around the bobbin. The iron core 22 is inserted at the through-hole of the bobbin. The yoke iron 23 is L-shaped, and one side of the yoke iron 23 is fixed with the iron core 22 at one end of the through-hole of the bobbin. A component assembled by the coil 21, the iron core 22 and the yoke iron 23 is installed on the base 1. The armature part 3 is L-shaped, and the armature part 3 is matched at the knife edge of the yoke iron 23. One side of the armature part 3 is connected with the movable spring 4, and the other side of the armature part 3 is matched with the iron core 22. The armature part 3 includes an armature 31 as the other side of the armature part, a connecting piece 32 as one side of the armature part, and a plastic member 33. The armature 31 and the connecting piece 32 are integrally connected through the plastic member 33 by means of insert molding. The armature 31 and the connecting piece 32 are insulated and isolated in the plastic member 33. The plastic member 33 is provided with at least one groove or at least one rib for increasing the creepage distance between the armature 31 and the connecting piece 32. As shown in FIG. 11, the present embodiment is to arrange a groove 331 on one side of the plastic member 33, and arrange two grooves 332 on the other side of the plastic member 33. As shown in FIG. 5, the stationary spring 5 includes a stationary reed 51. The stationary reed 51 includes a first coupling part 511 for fixing a stationary contact 52, a second coupling part 512 used as a lead-out pin, and a bending part 513 between the first coupling part and the second coupling part. The bending part 513 is located outside of a base plate 11 of the base 1 when the stationary reed 51 is mounted on the base 1.

As shown in FIG. 4, in the present embodiment, the base 1 is provided with a slot 12 for clamping the stationary reed 51. As shown in FIG. 5, the two sides of the first coupling part 511 of the stationary reed 51 in the width direction $W_5$ of the stationary reed 51 are provided with a convex part 5111, respectively. The stationary reed 51 is interference fit with the slot 12 of the base through the convex part 5111 on two sides of the stationary reed, such that the stationary reed 51 is clamped on the base 1.

As shown in FIG. 5, in the present embodiment, the upper edge of the convex part 5111 on two sides of the first coupling part 511 of the stationary reed 51 in the width direction $W_5$ of the stationary reed 51 is further designed as a slope 5112, so that the stationary reed 51 can be inserted into the base 1 from the outside of the base plate 11 of the base 1.

In the present embodiment, the stationary contact 52 is fixed on the inner side of the first coupling part 511 of the stationary reed 51 in the thickness direction $T_{511}$ of the first coupling part 511, so that the matching position of the movable contact and the stationary contact is above the bending part 513 of the stationary reed 51. Therefore, the magnetic field generated by the current flowing through the bending part 513 of the stationary reed can be utilized to generate an upward electrodynamic force at the disconnection position of the movable contact and the stationary contact to achieve arc extinguishing.

As shown in FIG. 4, in the present embodiment, at the edge corresponding to the slot 12, the base plate 11 of the base is further provided with a giving way part 13 that can be passed through by the stationary contact 52 fixed on the first coupling part 511 of the stationary reed 51.

As shown in FIG. 5, in the present embodiment, the bending part 513 of the stationary reed 51 is further provided with a through-hole 5131 along the thickness $T_{513}$ direction of the bending part 513.

In the present embodiment, the second coupling part 512 of the stationary reed 51 is designed as a bifurcation structure.

Figure 7:
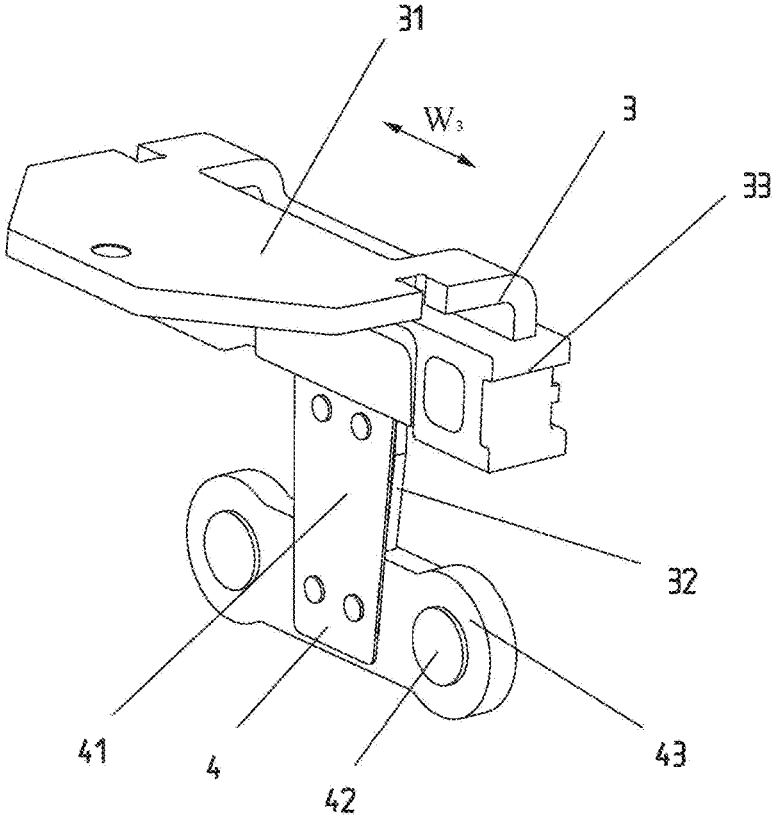
FIG. 7 is a perspective structure view of the armature part of the embodiment of the present disclosure.
Figure 8:
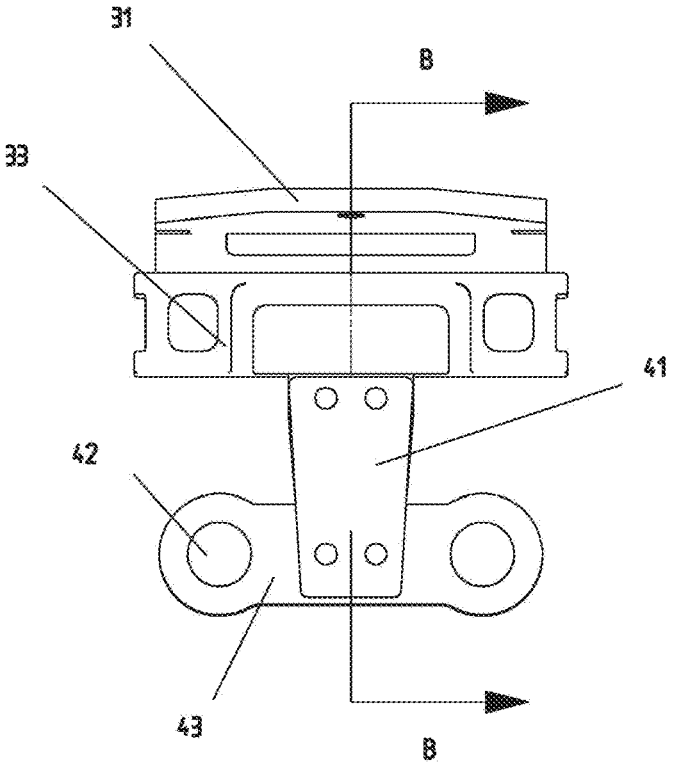
FIG. 8 is a front view of the armature part of the embodiment of the present disclosure.
Figure 9:
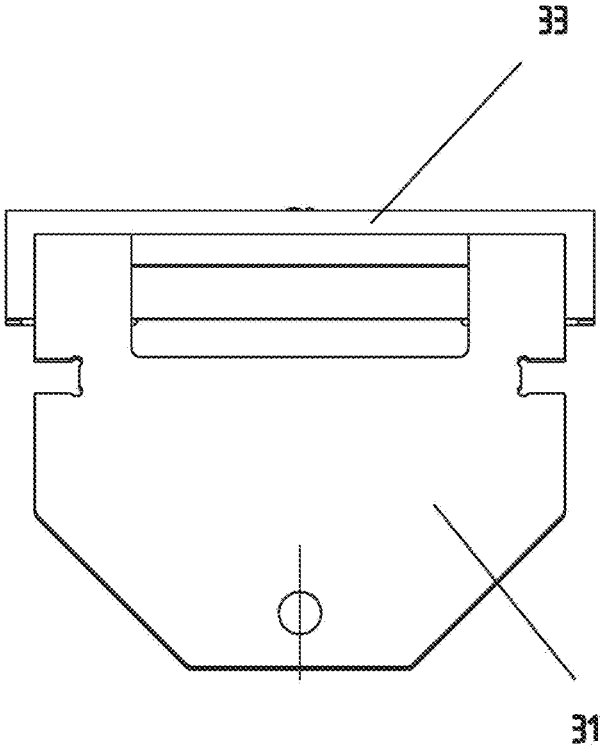
FIG. 9 is a top view of the armature part of the embodiment of the present disclosure.
Figure 10:
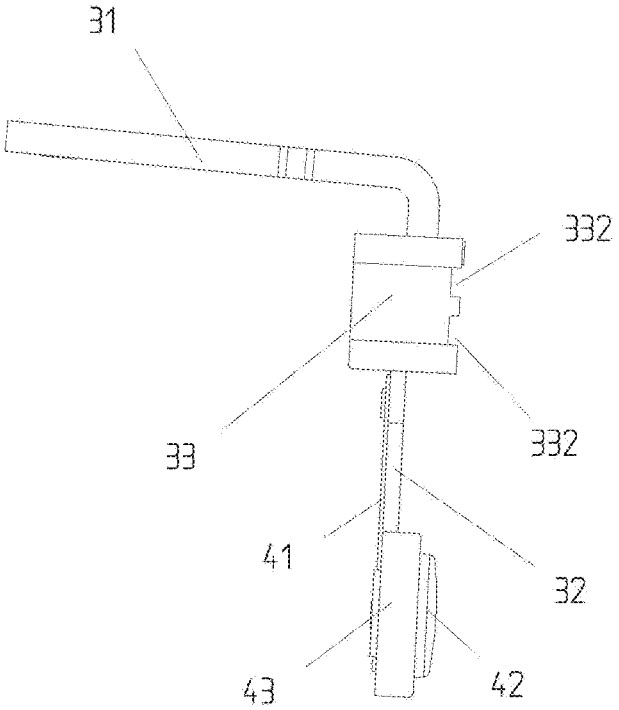
FIG. 10 is a side view of the armature part of the embodiment of the present disclosure.

As shown in FIG. 7 and FIG. 11, in the present embodiment, the grooves 331, 332 of the plastic member 33 are arranged along the width direction $W_3$ of the armature 31.

As shown in FIG. 7, in the movable spring 4 includes a movable reed 41, a movable contact 42 and a spacer 43. The movable contact 42 and the spacer 43 are fixed by riveting with each other to form a movable contact part. One end of the movable reed 41 and the connecting piece 32 of the armature part are fixed by riveting with each other. The other end of the movable reed 41 and the movable contact part are fixed with each other. The movable spring 4 in the embodiment of the present disclosure is a double-contact bridge structure.

In the present embodiment, the movable contact 42 and the spacer 43 are two separate parts. Of course, the movable contact and the spacer may also be an integral structure.

A high power and high insulation performance relay for a solar photovoltaic inverter in the embodiment of the present disclosure is adopted that an armature part 3 is designed to include an armature 31, a connecting piece 32 and a plastic member 33. The armature 31 and the connecting piece 32 are integrally connected through the plastic member 33 by means of insert molding. The armature 31 and the connecting piece 32 are insulated and isolated in the plastic member 33. The plastic member 33 is arranged with grooves 331, 332 for increasing the creepage distance between the armature and the connecting member. In such structure of the embodiment of the present disclosure, through adding grooves to the insert molding position of the armature part, the creepage distance between the connecting piece and the armature is increased under the condition of ensuring the strength of the insert molding, which can satisfy the product with a larger creepage distance (the creepage distance of the representing product is up to more than 12.5 mm), simple structure, convenient processing, and can satisfy the demand of high-voltage load.

A high power and high insulation performance relay for a solar photovoltaic inverter in the embodiment of the present disclosure is adopted that the stationary spring 51 is designed to include a first coupling part 511 for fixing a stationary contact, a second coupling part 512 used as a lead-out pin, and a bending part 513 between the first coupling part and the second coupling part. When the stationary reed 51 is mounted on the base 1, the bending part 513 is located outside of a base plate of the base. Such structure in the embodiment of the present disclosure can ensure that in the case of a specific lead-out pin position (the lead-out pin spacing can be adjusted according to the bending part), the splash during the process of switching the load are directly fell on the base, and the splash is prevented from falling directly on the metal (stationary reed) to cause the decline of the withstand voltage of the product, and the reliability of the insulation performance of the product is improved.

Figure 6:
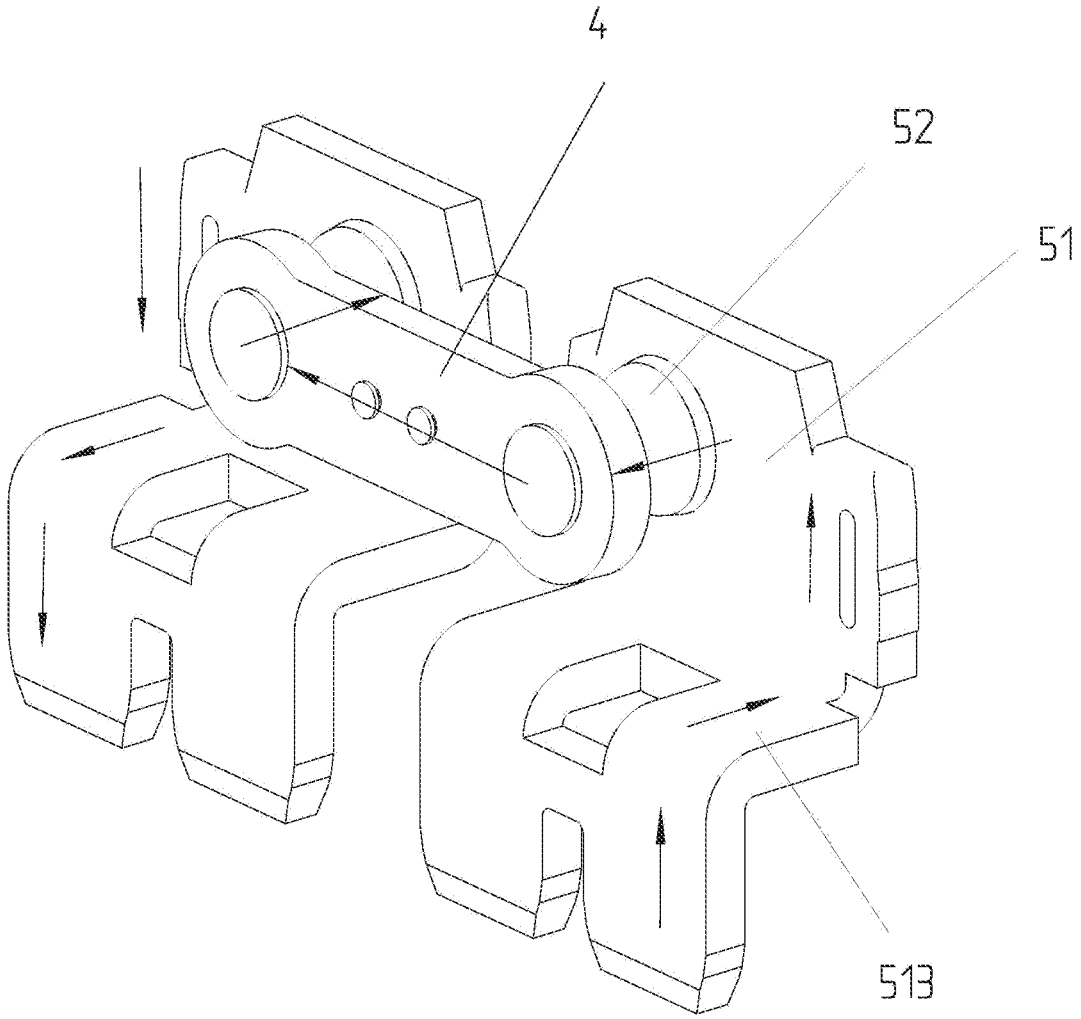
FIG. 6 is a schematic view of the movable contacts and the stationary contacts are in a state of matching with each other of the embodiment of the present disclosure.

A high power and high insulation performance relay for a solar photovoltaic inverter in the embodiment of the present disclosure is adopted that the bending part is designed on the stationary reed 51, and the stationary contact 52 is fixed on the inner side of the first coupling part 511 of the stationary reed in the thickness direction $T_{511}$ of the first coupling part 511, so that the matching position of the movable contact and the stationary contact is above the bending part of the stationary reed. As shown in FIG. 6, when the contact is disconnected from the load, an electric arc will be generated. By bending processing to the lead-out pin of the stationary spring, so that an electrodynamic force is generated by the lead-out pin of the stationary spring to lengthen the electric arc and speed up the electric arc extinguishing. Assuming that the current flows in from the right side stationary spring pin (as indicated by the arrow in FIG. 6), and flows out from the left side stationary spring pin, thus the current at the bending of the right side stationary spring pin is generated a magnetic field. According to the current flow direction, when the contacts are disconnected, the electrodynamic force on the electric arc is perpendicular to the bending part and upward. The left side stationary spring pin is in the same way. When the current is in the opposite direction, the direction of the electrodynamic force is still upward. Therefore, after the bending processing of the stationary reed, regardless of the current direction (applicable to the alternating current load), the electric arc thereof is all subjected to the vertical upward electrodynamic force, which can increase the arc extinguishing capability and provide the reliability of the contact switching load.

The embodiment of the present disclosure is adopted that a through-hole 5131 is further arranged in the bending part 513 of the stationary reed along the thickness direction $T_{513}$ of the bending part 5131, that is, the through-hole 5131 along the extending direction of the second coupling part 512 is opened at the bending part 513, and the second coupling part 512 of the stationary reed is designed as a bifurcation structure. The speed of heat transfer can be reduced, and the welding performance of the large capacity lead-out pin is improved.

Figure 12:
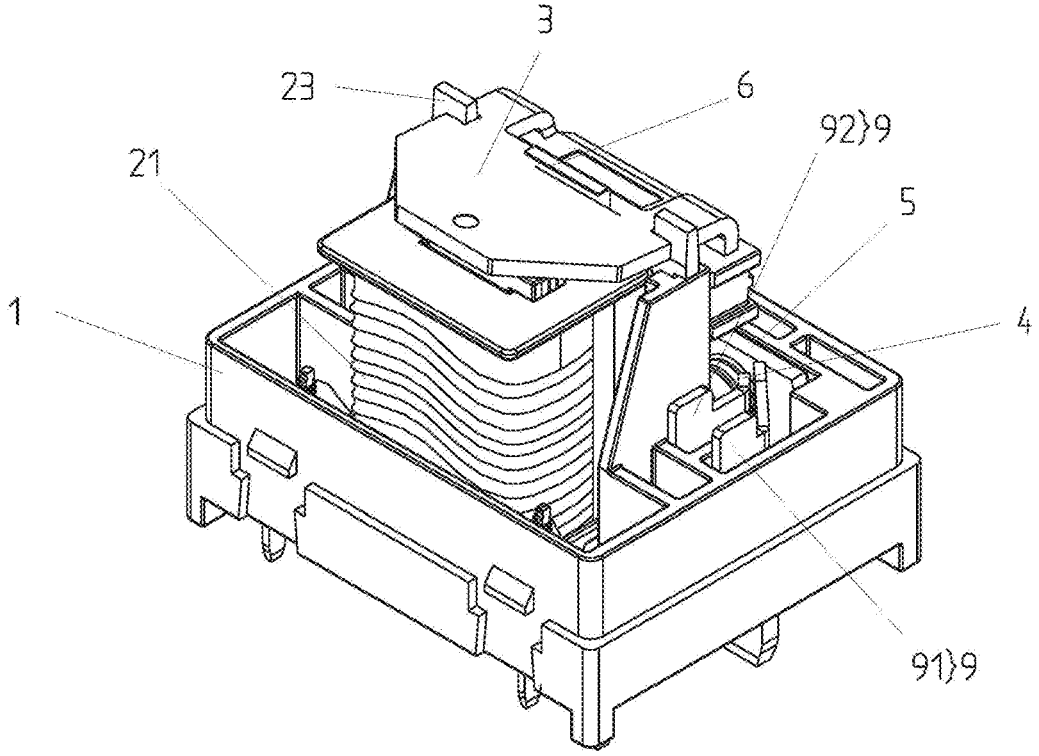
FIG. 12 is a perspective structure view of another embodiment of the present disclosure.
Figure 13:
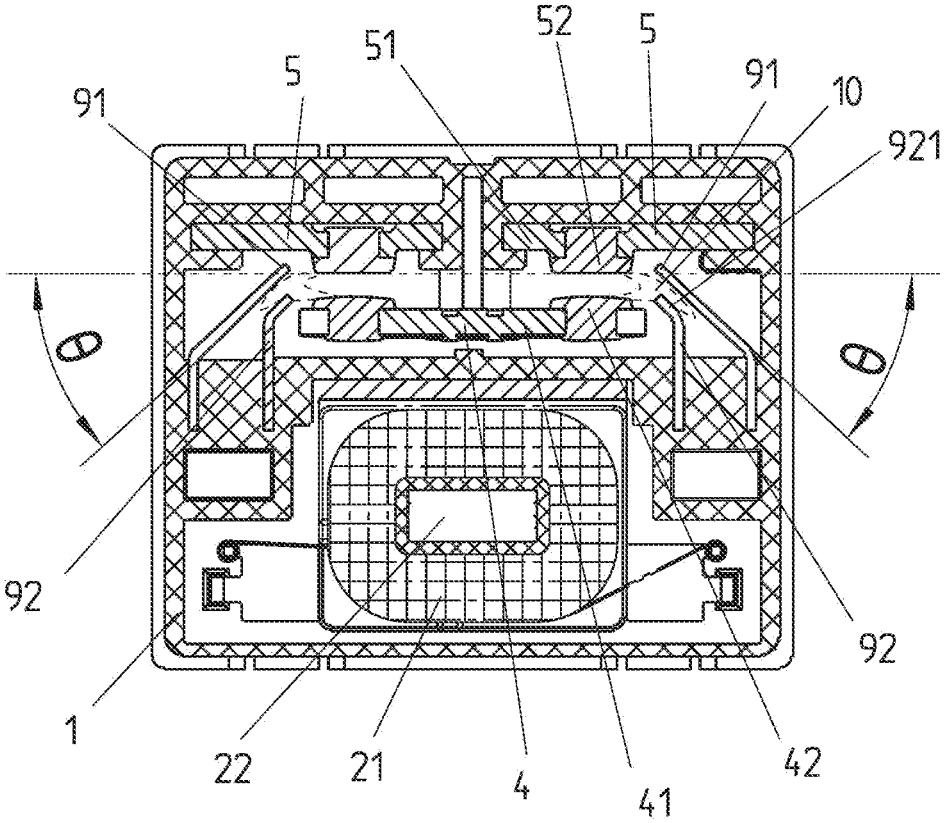
FIG. 13 is a structure cross-sectional view of another embodiment of the present disclosure.

Referring to FIG. 12 to FIG. 13, an electromagnetic relay resistant to high voltage and high current load is provided in another embodiment of the present disclosure, the electromagnetic relay includes a base 1, a coil 21, a yoke iron 23, an iron core 22, an armature part 3, a restoring reed 6, a bridge movable spring 4, a stationary spring 5, guide arc pieces and other components. In the embodiment, the bridge movable spring 4 includes two movable contacts 42 and a movable reed 41 that is bridged to the two movable contacts. The stationary spring 5 includes a stationary contact 52 and a stationary reed 51. The coil 21 and the yoke iron 23 are fixed by the iron core 22 to form a magnetic circuit part. The base 1 is a mainly used for supporting components. The magnetic circuit part, the stationary spring 5, the guide arc piece 9 etc. are fixed by the base 1. One end of the armature part 3 is riveted with the bridge movable spring 4. The rotating part in the middle of the armature part 3 is matched with the knife edge of the yoke iron 23 under the action of the restoring reed 6, and does not leave the knife edge of the yoke iron. The other end of the armature 3 is formed a magnetic pole that interacts with the iron core 22 to generate a suction. Under the action of the coil 21, the armature is sucked by the iron core 22, and then the action of the movable spring group is actuated, thereby achieving the movement of the movable contact 42 on the movable spring group to the stationary contact 52 of the stationary spring, and achieving the circuit connection. On the contrary, the movable spring group is left from the stationary spring through the reaction force generated by the restoring reed 6 to achieve the circuit disjunction when the coil 21 is power-off.

In an electromagnetic relay resistant to high voltage and high current load in the embodiment of the present disclosure, two movable contacts 42 are correspondingly matched with two stationary contacts 52. One of the stationary contacts 52 is set as current inflow. The other stationary contact 52 is set as current outflow. Thereby the electric arc 10 generated between the two pairs of contacts is splashed outwards along the line connecting the gaps of the two pairs of contacts. Since the two pairs of contacts are adopted a bridge series mode, whether for an alternating current load or a direct current load, the current flowing through the two pairs of contacts must be "equal in size, opposite in direction", and the electric arc generated between the two pairs of contacts must be mutually exclusive. Therefore, the two electric arcs must be moved in the direction away from each other, that is, moving outwards along the outside of the line connecting the gaps of the two pairs of contacts. A first guide arc piece 91 is respectively arranged at the outside of the line connecting the gaps of the two pairs of contacts to prevent the corresponding electric arc from flying outwards along the line connecting the gaps of the two pairs of contacts. The first guide arc piece 91 is made of a conductive metal material. The first guide arc piece 91 with respect to the connecting line of the gaps of the two pairs of contacts is obliquely arranged to enable the blocked electric arc to be guided to move along the preset arc leading direction of the first guide arc piece. That is, the first guide arc piece 91 is at an angle θ to the line connecting the gaps of the two pairs of contacts.

In the present embodiment, the first guide arc piece 91 and the contact circuit are insulated from each other. One end of the first guide arc piece 91 is fixed on a side away from the stationary contact 52. The other end of the first guide arc piece 91 is extended from the fixed position towards the direction of the stationary contact until to a position close to the stationary contact, so that the preset arc leading direction is towards the direction away from the stationary contact.

In the present embodiment, a second guide arc piece 92 is further respectively arranged at the outside of the line connecting the gaps of the two pairs of contacts. The second arc guide 92 is made of a conductive metal material. The second guide arc piece 92 and the contact circuit are insulated from each other. The second guide arc piece 92 and the first guide arc piece 91 are also insulated from each other. One end of the second guide arc piece 92 is fixed on a side away from the stationary contact. The other end of the second guide arc piece 92 is extended from the fixed position towards the direction of the contact gap until to a position close to the movable contact, so that the first guide arc piece 91 and the second guide arc piece 92 are enclosed to form a guide arc channel, and the preset arc leading direction is towards the direction away from the stationary contact.

In the present embodiment, the size of the distance between the other end of the first guide arc piece 91 and the other end of the second guide arc piece 92 is not less than the size of the contact gap. Thereby, the electric arc generated between the contacts can be largely entered into the guide arc channel surrounded by the first guide arc piece 91 and the second guide arc piece 92.

In the present embodiment, the size of the distance between the fixed position of one end of the first guide arc piece 91 and the fixed position of one end of the second guide arc piece 92 is greater than the size of the distance between the other end of the first guide arc piece and the other end of the second guide arc piece, so that the guide arc channel is as a trumpet shape structure with a small opening and a large inside.

In the present embodiment, the other end of the second guide arc piece 92 is provided with a bending part. The tail end 921 of the other end of the second guide arc piece is approximately parallel to the other end of the first guide arc piece 91.

The first guide arc piece 91 and the second guide arc piece 92 are fixed on the base 1, respectively.

An electromagnetic relay resistant to high voltage and high current load in the embodiment of the present disclosure is provided with at least one guide arc piece which is respectively arranged at the outside of the line connecting the two pairs of contacts and used for preventing the corresponding electric arc from flying outwards along the line connecting the two pairs of contacts. The guide arc piece is made of a conductive metal material. The guide arc piece with respect to the connecting line of the two pairs of contacts is obliquely arranged to enable the blocked electric arc can be guided to move along the preset arc leading direction of the guide arc piece. In such structure of the embodiment of the present disclosure, through arranging a conductive metal guide arc piece, the electric arc is immediately formed a multi-segment short arcs in series when the moving electric arc hits the conductive metal guide arc piece, so that the voltage between each segment short arc has a double drop, and greatly reducing the recovery rate of the voltage and reducing the energy of the arc. Further, the arc burning point is moved along the surface of the metal guide arc piece, thereby accelerating the heat dissipation and speeding up the recovery rate of the medium. Therefore, for direct current electric arc, the electric arc is more easily extinguished. For alternating current arc, the problem of the electric arc reignition can be effectively avoided when the voltage crosses zero. In the embodiment of the present disclosure, a certain included angle between the arranged metal guide arc piece and the line connecting the gaps of the two pairs of contacts is formed. In addition to preventing the change of the electric arc direction, the metal guide arc piece can also guide the electric arc to move along the metal surface By properly setting the angle of the guide arc piece, the electric arc can be effectively guided to move towards the direction away from the plastic to avoid the electric arc burning the plastic.

In an electromagnetic relay resistant to high voltage and high current load in the embodiment of the present disclosure, whether a direct current load or an alternating current load, the electric arcs generated by the two pairs of contacts are all moved towards the direction away from each other. Therefore, the arc extinguishing object may be direct current, and may also be alternating current. In order to prevent the electric arc from burning the plastic, the guide arc piece designed in the embodiment of the present disclosure is adopted not only the manner of "blocking" the electric arc, but also the manner of "guiding" the electric arc and guiding the heat dissipation, thereby the arc extinguishing effect is better. The embodiment of the present disclosure can reconstitute the electric arc into multi-segment short arcs to reduce the electric arc voltage and slow down the recovery speed of the voltage.

Figure 14:
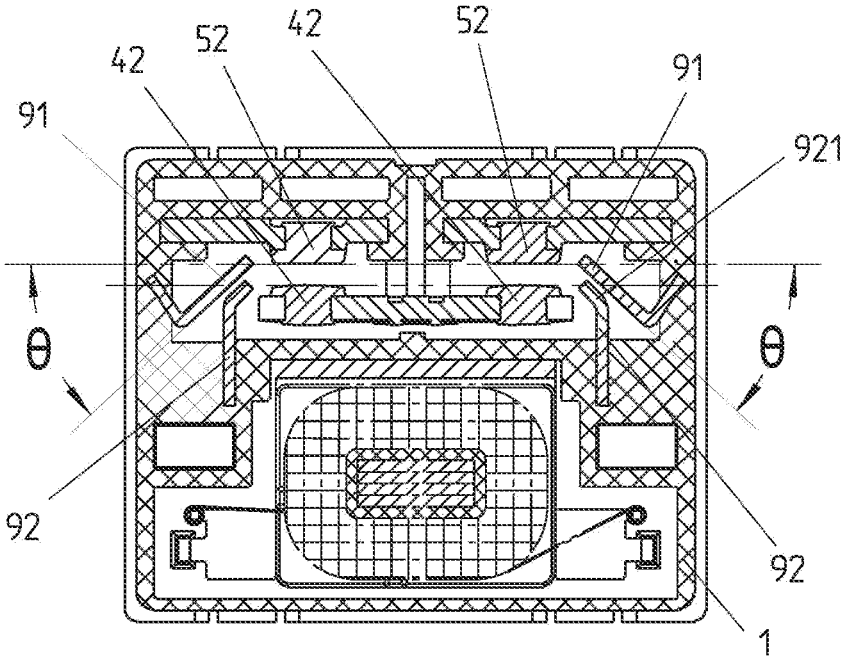
FIG. 14 is a structure cross-sectional view of another embodiment of the present disclosure.

Referring to FIG. 14, an electromagnetic relay resistant to high voltage and high current load in the embodiment of the present disclosure is different from the embodiment shown in FIG. 13 in that the fixed position of one end of the first guide arc piece 91 is different. One end of the first guide arc piece 91 in the present embodiment is fixed at the edge of the base 1.

Figure 15:
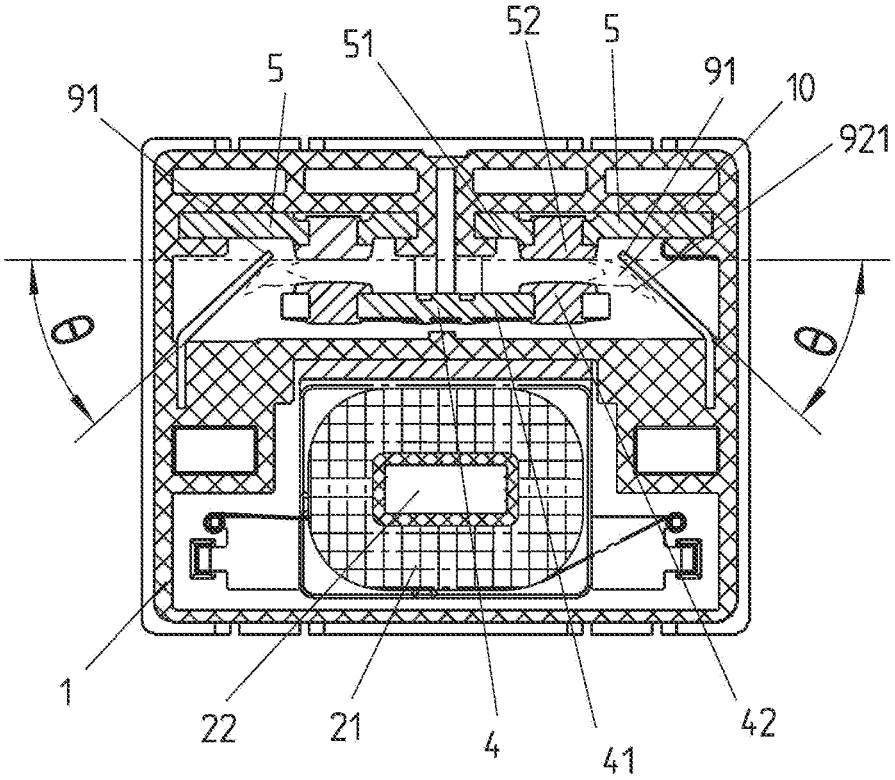
FIG. 15 is a structure cross-sectional view of another embodiment of the present disclosure.

Referring to FIG. 15, an electromagnetic relay resistant to high voltage and high current load in the embodiment of the present disclosure is different from the embodiment shown in FIG. 13 and FIG. 14 in that there is no second guide arc piece 92. Both "blocking" the electric arc and "guiding" the electric arc are achieved by the first guide arc piece 91.

Of course, as needed, a third guide arc piece may be added on the basis of setting the first guide arc piece 91 and the second guide arc piece 92. The third guide arc piece may be one piece, and may also be a plurality of pieces. The third guide arc piece is also made of a conductive metal material. The third guide arc piece and the contact circuit are insulated from each other. The third guide arc piece and the first guide arc piece, the second guide arc piece are also insulated from each other. The third guide arc piece is disposed between the first guide arc piece and the second guide arc piece, or disposed outside the first guide arc piece and the second guide arc piece.

The above mentioned embodiments are only preferred embodiments of the present disclosure, and are not intended to limit the present disclosure in any form. Although the present disclosure has been disclosed in a better embodiment as above, it is not intended to limit the present disclosure. Those skilled in the art, under the condition of without departing from the technical solution scope of the present disclosure, can make many possible variations and modifications to the technical solution of the present disclosure, or modify the above embodiments into equivalent embodiments, by utilizing the technical contents disclosed above. Therefore, without departing from the content of the technical solution of the present disclosure, any simple alterations, equivalent changes and modifications made to the above embodiments in accordance with the technical essence of the present disclosure should all fall within the scope protected by the technical solution of the present disclosure.

What is claimed is:

1. A high power and high insulation performance relay for a solar photovoltaic inverter, comprising a base, a coil, an iron core, an armature part, a yoke iron, a movable spring and a stationary spring; the coil, the iron core and the yoke iron are matched with each other and mounted on the base; the armature part is L-shaped, and the armature part is matched at the knife edge of the yoke iron; one side of the armature part is connected with the movable spring, and the other side of the armature part is matched with the iron core; characterized in that, the armature part includes an armature as the other side of the armature part, a connecting piece as one side of the armature part, and a plastic member; the armature and the connecting piece are connected with the plastic member respectively, and the armature and the connecting piece are insulated and isolated in the plastic member; the plastic member is arranged with at least one groove or at least one rib for increasing the creepage distance between the armature and the connecting piece; the stationary spring comprising a stationary reed; the stationary reed includes a first coupling part for fixing a stationary contact, a second coupling part used as a lead-out pin, and a bending part between the first coupling part and the second coupling part; the bending part is located outside of a base plate of the base when the stationary reed is mounted on the base.

2. The high power and high insulation performance relay for a solar photovoltaic inverter according to claim 1, wherein the stationary contact is fixed on the inner side of the first coupling part of the stationary reed in the thickness direction of the first coupling part, a matching position of a movable contact and the stationary contacts is above the bending part of the stationary reed; a magnetic field generated by a current flowing through the bending part of the stationary reed can be utilized to generate an upward electrodynamic force at a disconnection position of the movable contact and the stationary contacts to achieve arc extinguishing.

3. The high power and high insulation performance relay for a solar photovoltaic inverter according to claim 1, wherein the armature and the connecting piece are integrally connected through the plastic member by means of insert molding.

4. The high power and high insulation performance relay for a solar photovoltaic inverter according to claim 1, wherein the base is provided with a slot for clamping the stationary reed; two sides of the first coupling part of the stationary reed in the width direction of the stationary reed are provided with a convex part respectively; the stationary reed is interference fit with the slot of the base by means of the convex parts on two sides of the stationary reed, the stationary reed is clamped on the base.

5. The high power and high insulation performance relay for a solar photovoltaic inverter according to claim 4, wherein a upper edge of the convex part on two sides of the first coupling part of the stationary reed in the width direction of the stationary reed is further designed as a slope, the stationary reed is inserted into the base from the outside of the base plate of the base.

6. The high power and high insulation performance relay for a solar photovoltaic inverter according to claim 4, wherein at an edge corresponding to the slot, the base plate of the base is further provided with a giving way part that can be passed through by the stationary contact fixed on the first coupling part of the stationary reed.

7. The high power and high insulation performance relay for a solar photovoltaic inverter according to claim 1, wherein the bending part of the stationary reed is further provided with a through-hole along the thickness direction of the bending part.

8. The high power and high insulation performance relay for a solar photovoltaic inverter according to claim 1, wherein the second coupling part of the stationary reed is designed as a bifurcation structure.

9. The high power and high insulation performance relay for a solar photovoltaic inverter according to claim 1, wherein the groove or the rib of the plastic member is arranged along the width direction of the armature.

10. The high power and high insulation performance relay for a solar photovoltaic inverter according to claim 1, wherein the movable spring comprises a movable reed, a movable contact and a spacer; the movable contact and the spacer are fixed by riveting with each other to form a movable contact part; one end of the movable reed and the connecting piece of the armature part are fixed by riveting with each other; the other end of the movable reed and the movable contact part are fixed with each other.

11. The high power and high insulation performance relay for a solar photovoltaic inverter according to claim 10, wherein the movable contact and the spacer are an integral structure or two separate parts.

* * * * *